US008485262B1

(12) United States Patent
Angers

(10) Patent No.: US 8,485,262 B1
(45) Date of Patent: Jul. 16, 2013

(54) MODULAR, STACKABLE WELLHEAD SYSTEM

(76) Inventor: John W. Angers, Youngsville, LA (US)

( * ) Notice: Subject to any disclaimer, the term of this patent is extended or adjusted under 35 U.S.C. 154(b) by 0 days.

(21) Appl. No.: 13/448,276

(22) Filed: Apr. 16, 2012

Related U.S. Application Data

(62) Division of application No. 12/567,575, filed on Sep. 25, 2009, now abandoned.

(60) Provisional application No. 61/225,123, filed on Jul. 13, 2009, provisional application No. 61/212,801, filed on Apr. 16, 2009, provisional application No. 61/100,642, filed on Sep. 26, 2008.

(51) Int. Cl.
*E21B 23/00* (2006.01)

(52) U.S. Cl.
USPC ..... 166/368; 166/339; 166/351; 166/85.1; 166/75.13; 285/123.1

(58) Field of Classification Search
USPC ..... 166/368, 338, 339, 344, 351, 360, 166/378–380, 85.1, 75.13; 285/420, 421, 285/123.1
See application file for complete search history.

(56) References Cited

U.S. PATENT DOCUMENTS 1,121,718 A * 12/1914 Derby et al. ..... 254/31
1,454,088 A 5/1923 Thrift
1,894,039 A * 1/1933 Hill ..... 175/171
2,126,933 A 8/1938 Stone et al.
2,897,895 A * 8/1959 Ortloff ..... 166/95.1
RE25,680 E * 11/1964 Brown ..... 254/29 R
3,321,217 A * 5/1967 Ahlstone ..... 285/18
3,606,393 A * 9/1971 Huntsinger et al. ..... 85/90
3,848,898 A * 11/1974 De Panafieu et al. ..... 285/61
4,127,289 A * 11/1978 Daspit ..... 285/322
4,437,515 A 3/1984 Boyadjieff
4,465,131 A * 8/1984 Boyadjieff et al. ..... 166/77.4
4,476,936 A * 10/1984 Boyadjieff et al. ..... 166/383
4,479,547 A * 10/1984 Boyadjieff et al. ..... 166/383
4,595,062 A * 6/1986 Boyadjieff et al. ..... 166/379
4,653,778 A * 3/1987 Alandy ..... 285/18
4,799,714 A * 1/1989 Collet ..... 285/123.11
5,158,326 A * 10/1992 Anderson et al. ..... 285/3
5,291,651 A * 3/1994 Frame ..... 29/726
5,332,043 A * 7/1994 Ferguson ..... 166/379
5,899,507 A * 5/1999 Schroeder et al. ..... 285/343
6,015,009 A * 1/2000 Allen ..... 166/89.3
6,129,149 A * 10/2000 Beall ..... 166/344
6,234,252 B1 * 5/2001 Pallini et al. ..... 166/345
6,234,253 B1 5/2001 Dallas
6,293,343 B1 * 9/2001 Pallini et al. ..... 166/345
6,609,734 B1 * 8/2003 Baugh ..... 285/322

(Continued)

*Primary Examiner* — Matthew Buck
(74) *Attorney, Agent, or Firm* — Joseph T Regard, Ltd PLC

(57) ABSTRACT

A modular wellhead system having the capability for single or dual annulus via interchangeable heads, a unique capping system, and other features. A unique wellhead manual positive lock system incorporating an energizable inner bite ring for engaging the casing tubing, a compressible slip hanger for the tubing, as well as a hydraulic jack for lifting the tubing from the well to reintroduce tension are provided, the system being particularly suitable for use in conjunction with repair or low pressure plug and abandon (P&A) operations. Components of the system are designed for assembly via locking pins for diver friendly operation, While the present system is designed principally for use in subsea environments, the system can likewise be utilized on land or platforms.

11 Claims, 11 Drawing Sheets

U.S. PATENT DOCUMENTS 6,712,147 B2 * 3/2004 Dallas ..... 166/379
6,834,718 B2 * 12/2004 Webster ..... 166/89.3
7,686,087 B2 * 3/2010 Pallini et al. ..... 166/367
7,798,208 B2 * 9/2010 Purkis ..... 166/75.14
8,006,764 B2 * 8/2011 Adamek et al. ..... 166/348
8,061,419 B2 * 11/2011 Khazanovich et al. ..... 166/89.3
8,074,722 B2 * 12/2011 Murphy et al. ..... 166/379

* cited by examiner

MODULAR, STACKABLE WELLHEAD SYSTEM

PRIORITY AND BENEFIT CLAIM

The present application is a Divisional of U.S. Utility patent application Ser. No. 12/567,575 filed Sep. 25, 2009 now abandoned entitled MODULAR, STACKABLE WELLHEAD SYSTEM, which claimed the benefit of U.S. Provisional Application Ser. No. 61/100,642, Filed Sep. 26, 2008, entitled HYDRAULIC TUBING WELLHEAD; said Ser. No. 12/567,575 application also claimed the benefit of U.S. Provisional Application Ser. No. 61/212,801, Filed Apr. 16, 2009, entitled HYDRAULIC TUBING WELLHEAD and MODULAR, STACKABLE WELLHEAD SYSTEM; said Ser. No. 12/567,575 application claimed the benefit of U.S. Provisional Application Ser. No. 61/225,123, Filed Jul. 13, 2009, entitled HYDRAULIC TUBING WELLHEAD and MODULAR, STACKABLE WELLHEAD SYSTEM.

FIELD OF THE INVENTION

The present invention relates to wellheads, and in particular to a modular wellhead system having the capability for single or dual annulus via interchangeable heads, a unique capping system, and other features. A unique wellhead manual positive lock system incorporating an energizable inner bite ring for engaging the casing tubing, a compressible slip hanger for the tubing, as well as a hydraulic jack for lifting the tubing from the well to reintroduce tension is provided, the system being particularly suitable for use in conjunction with repair or low pressure plug and abandon (P&A) operations. Components of the system are designed for assembly via locking pins for diver friendly operation, While the present system is designed principally for use in subsea environments, the system can likewise be utilized on land or platforms.

GENERAL BACKGROUND DISCUSSION OF THE INVENTION

Hurricane Katrina left a path of devastation through hydrocarbon recovery facilities in the Gulf of Mexico. As a result, many wells and production platforms were heavily damaged or destroyed. Many of the these facilities were inactive or nominal producers, and accordingly did not merit repair or reactivation after the storm.

Federal law and/or state law prohibits abandonment of wells or production platforms without proper decommissioning. Accordingly, the owners/operators of these facilities are obligated to remove the damaged structures associated with these facilities, and either repair the well for production, or properly plug and abandon (P&A) so that there is no structure above the mud line.

Many such damaged wells have had their casing structure damaged, or tubing in compression due to the structures collapse during the storm. In other instances, the tubing became corkscrewed or otherwise bent due to the compression. Once the string and top have been cut away, the remaining facilities located in water were submerged and inaccessible without equipment which could operate underwater. Therefore, the process of using conventional wellheads in an underwater environment has become cumbersome and expensive to retrofit and install.

Traditionally, a jack-up barge or other specialized vessel would be required to be located on site to latch on to the tubing and pull it out of the hole via wireline or the like for workover.

Often, due to obstruction, the vessel is not able to get directly over the tubing to pull it from the well without further bending the pipe.

Further, the tubing may be bent, compressed, or otherwise damaged in the well, and thus cannot be easily lifted from the well. Vessels for tubing recovery are in short supply, and even when they are available, they can be extremely expensive, especially for use in a P&A operation, or a repair operation on a nominally producing well. Further, if the well is at an angle due to collapse or other catastrophic failure (such as pushed over platforms or the like), this further limits the availability of vessels which could handle the operation.

SUMMARY DISCUSSION OF THE INVENTION

The preferred embodiment of the present invention provides a novel system for use with vertical as well as directional wells for workover or P&A situations at the wellhead, providing a portable, modular, build-to-suit system to provide a custom wellhead solution for repair, low pressure P&A, and other operations. The present modular system is both single or dual annulus well capable, providing a hydraulic lifting capacity for lifting casing/tubing coupled with engagement/support capacity for selectively supporting the tubing.

The present system is suitable for use/operation in a subsea environment by divers without the necessity for a jack-up barge or the like. The system provides a reusable casing head sealing unit combined with the hydraulic jacking system. The system is quickly reconfigured, assembled and/or disassembled utilizing primarily locking pins.

An effective means of capping the casing, along with the feature of being able to pull back tension into the tubing, in a single operation. This allows the user to quickly install the head, pack off, test and lock onto the casing, along with enabling the operator to pull tension, set the slips and seal off on the tubing in relatively a single operation.

Further, the present system contemplates a detachable lower casing head element/bowl assembly and includes a unique reverse wedge locking element to prevent pressure "push off". Tension may be applied to the tubing utilizing a ratcheting affect via the attachable jacking assembly. This unique locking system allows the operator to apply pressure about the casing from the outside of the head, to energize a wedge lock ring to engage the outer diameter of the casing to which the head is to be mounted to. Once locked on by the locking rings (also referenced as "bite rings"), the head will is anchored to the casing and will have very limited upward motion until such time that the tightness overcomes the pressure. Fluid pressure inside the casing urging the head upward only serves to further tighten the bite rings grip about the casing, further securing the head to the casing.

The hydraulic jacking system associated with the present system is easily installable or removeable as necessary. Once the jacking operation is completed, a dry hole cap can be slipped over the bowl assembly to secure the top of the head. Once the head is secured, a tubing cap can be installed and anchored down to the dry hole cap, securing the well bore until further work, such as completion, is required. The hydraulic jacking system can also be used with a conventional wellhead, with the wellhead adapter flange (also referenced as a lower jack plate) taught in this application.

The tubing cap can be placed on the top of the tubing as far away as required (for example, four feet or better), to allow the tubing to be exposed, in order to allow for ease of handling upon return for decompleting.

All major component pieces in the present system have interchangeable bushings to allow them to fit a variety of casing combinations, for example, 13⅜, 10¾, 9⅝, and 7⅝ casings, or 3½, 2⅞, 2⅜ tubings.

The present system is particularly suitable for such applications as, for example:

Well bore capping for cementing

Well bore capping for testing

Unique features of the present invention include, but are not limited to:

- the unique QUICK LOCK double wedge locking (bite ring) system which allows for easy and effective anchoring of temporary wellheads, caps, and the like;
- interchangeable casing bushings to fit a variety of casings and tubings;
- a unique dry hole cap with interchangeable bushings;
- a unique crown cap with interchangeable bushings The system includes Interchangeable btm bushings which allow the head to be utilized with various casing sizes.

Also, the top cap to this system can also be equipped with interchangeable bushings to give the system versatility on multiple projects without the need to purchase multiple wellheads for each well bore.

Once the well bore has been sealed, removal and adopting the head for the next well is relatively simple, and can be done on location.

The system provides for a single annulus operation or dual annulus (depending upon the site requirements) by changing the head. A dual annulus head allows for the operator to seal two well casings (for example, a surface casing and production casing) simultaneously without the need for separate, multistage heads. A casing centralizer is provided to position the casing before installation with the dual annulus head. A unique centralizer and locking system allows for both casings to be locked into position. Slip bowl assemblies are also provided which are interchangeable for various diameters and are DHCVL capable, and allow for diver friendly cable handling.

Along with all of the above mentioned equipment, air over hydraulics can be utilized to operate the jacking system to facilitate easier functionality on most boats, without a large hydraulic power pack system.

Other features will be discussed in the detailed description of the invention herein.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
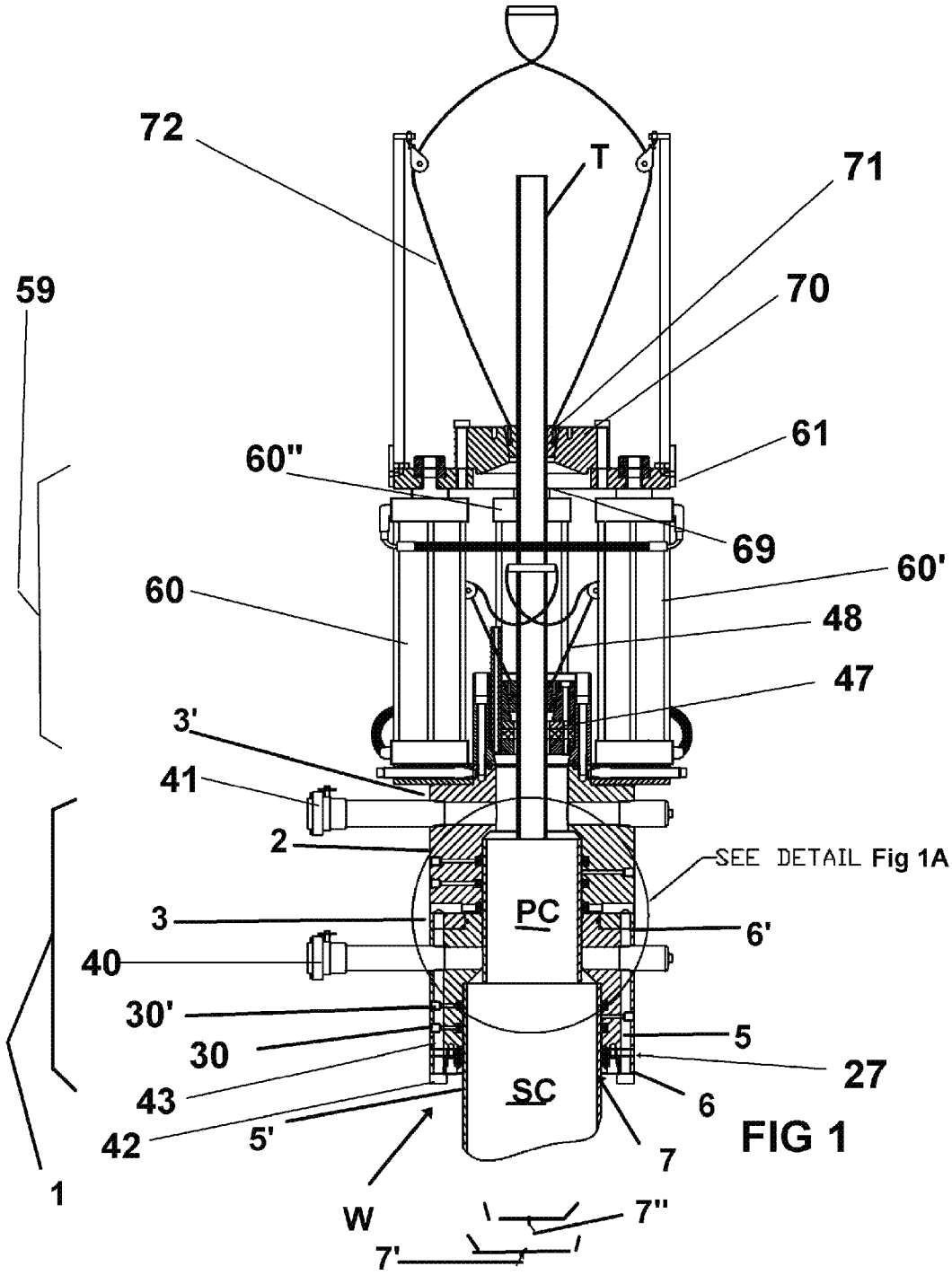
FIG. 1 is a side, partially cut-away view of a unique, two piece stacked wellhead system for dual annulus of the present invention with a unique tubing jack and other components and features mounted thereto.

Referring to FIG. 1, a modular, stackable wellhead 1 is shown, for use with at a well site W having an include outer surface casing SC having production casing PC coaxially emanating therefrom. Tubing T is coaxially situated within the production casing for ingress or egress from the well.

The Lower Casing Head

A dual annulus wellhead arrangement is shown for the present well site, wherein there is provided a lower casing head 5 having first 6 and second 6' ends with a passage 7 formed therethrough having inner diameters, 7', 7" with inner diameter 7' formed to envelope the outer diameter 5' of surface casing SC or the like.

As shown in FIGS. 1, 3A-3B and 3C, situated along the inner diameter 7' of passageway 7 formed in the lower casing head 5 is an anchor mechanism utilizing a reverse wedge locking system 27 for selectively anchoring the lower casing head to the surface casing SC, comprising a bite ring slot 8 formed to receive an inner bite ring 9. The inner bite ring 9 is in a circular, ring configuration, but with a gap (for example, ⅝" for a 9⅝" size but varying depending upon its size) along its diameter to allow for a compression or decrease in the diameter when force is applied to the outer diameter 9", as will be further detailed infra.

The inner bite ring 9 has an inner diameter 9' having a gripping surface 10, the preferred embodiment utilizing a gripping surface 10 comprising rows of serrated teeth 11, each row of teeth having a point 12 oriented towards the upper end of the casing to which it engages. The outer diameter 9" of the inner bite ring 9 has a taper 13' in a first direction 14 to form a wedge profile.

Situated about said inner bite ring 9 is a wedge ring 13 having an inner diameter 14' and an outer diameter 14", said inner diameter 14' having a smooth surface 15 formed to engage said outer diameter 9" of said inner bite ring 9, said wedge ring 13 situated in said bite ring slot 8 between said inner bite ring and said lower casing head, said inner diameter 14' of said wedge ring 13 being tapered 16 in a second direction 17 opposite to said first direction 14 of said inner bite ring 9 to form a wedge profile, said inner diameter 14' of said wedge ring 13 formed to engage said outer diameter 9" of said inner bite ring 9.

Actuation screws 18 are spaced about the circumference of the wellhead (six actuation screws in a 9⅝ or smaller wellhead, 8 or more for a larger wellhead, depending upon the size) about the bite ring slot 8 via threaded 19 apertures 20 running from the outer surface of the lower casing head to the bite ring slot. The turning 21 of the screw 18 urges 22 wedge ring against 23 the tapered outer diameter 14' of inner bite ring to decrease 24 the diameter of said inner bite ring, so as to urge said gripping surface of said inner bite ring against said the outer diameter of casing so as to grip same.

Further, the wedge ring and inner bite ring tapered inner diameter wedge configuration configures to manipulate with the serrated teeth forming the gripping surface 10 such that, wherein fluid pressure from the end of said casing applied to said lower casing head urges 25 said wedge ring 13 to apply further pressure to said inner bite ring 9 so as to increase pressure of said gripping surface against said casing, providing an unique, effective and stable, yet easily installed and removed wellhead anchoring system (also referenced as the "locking ring").

Situated above the anchor mechanism is packing injection port (PIP) 30, 30', as shown wherein packing is injected into the seal area to form a p-seal, utilizing known industry products and methodology. Packing ejection ports (PEP) associated with the seal areas 9, 9', for overflow, may also be utilized.

Figures 4A, 4B, 4C:
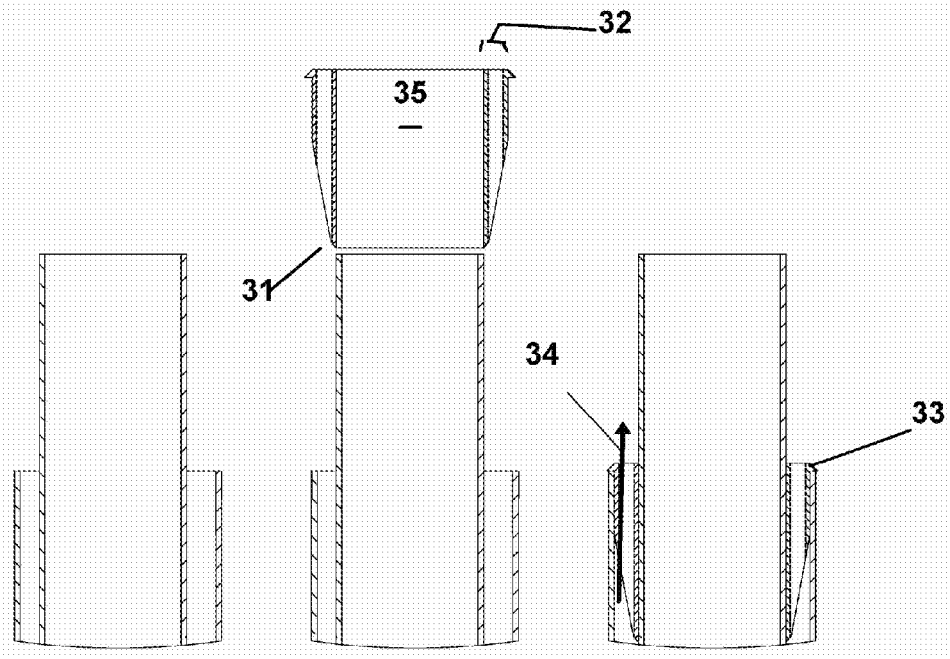
FIG. 4A is a view of the casings forming a wellhead in wedding cake configuration.
FIG. 4B is a view of a ported centralizer to be inserted between the two casings.
FIG. 4C illustrates the ported centralizer of 4B inserted between the two casings.
Figure 5:
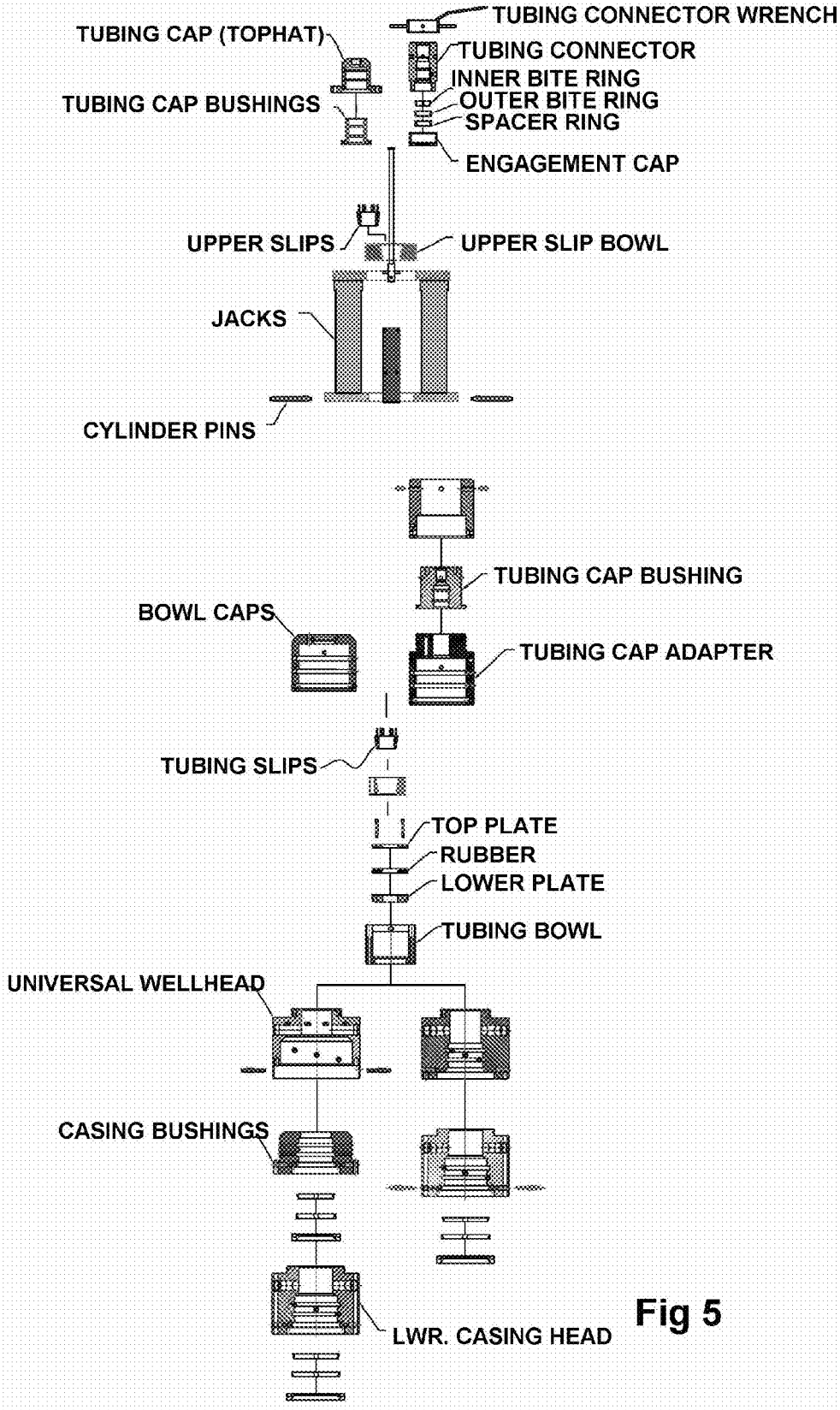
FIG. 5 illustrates the various components of the present invention in categorized form, and illustrating the relative placement of one to the other.

Referring to FIGS. 4A-4C, the prior to installation of the wellhead (including the lower casing head, the production casing is "wedding caked", that is, the surface casing and production casing are cut such that the production casing emanates from the surface casing at a predetermined range suitable for mounting the dual annulus wellhead arrangement. The production casing is then centered in the surface casing via the use of a fluted centralizer 35, which comprises a cylindrical spacer which is tapered to a point 31 at the base and spaced to the desired spacing 32 at the top. The centralizer has an inner diameter formed to engage the outer diameter of the production casing, and an outer diameter to engage the inner diameter of the surface casing, and a lip 33, to ride atop the surface casing to retain the centralizer in place, centering the production casing vis a vis the surface casing. Vent apertures are formed through the centralizer to allow passage of fluid pressure 34 therethrough.

It is noted that another centralizer having similar configuration is preferably also used center the tubing T emanating from the production casing (although different measurements to accommodate the reduced diameters), as will be discussed further infra.

An annular vent 40 is provided above the PIP in the lower casing head to vent from the surface casing area, as is common on many wellheads. The annular vents allow one to communicate to the bore between the two pipes, whether to solidify with cement or gel, or seal off the zone before the two casings. This port allows access to the space between the two casings (production casing and surface casing).

The Upper Wellhead Portion

The first end 3 of the upper wellhead portion 2 is mounted to the second end 6' of the lower casing head 5 via a series of threaded bolts 42 passing through respective threaded apertures 43 passing through the first end 6 of the lower casing head, through its length, into the first end 3 of the upper wellhead portion (six bolts 42 may be used in a 9⅝ or smaller wellhead, 8 or more for a larger wellhead, depending upon the size).

Figure 1A:
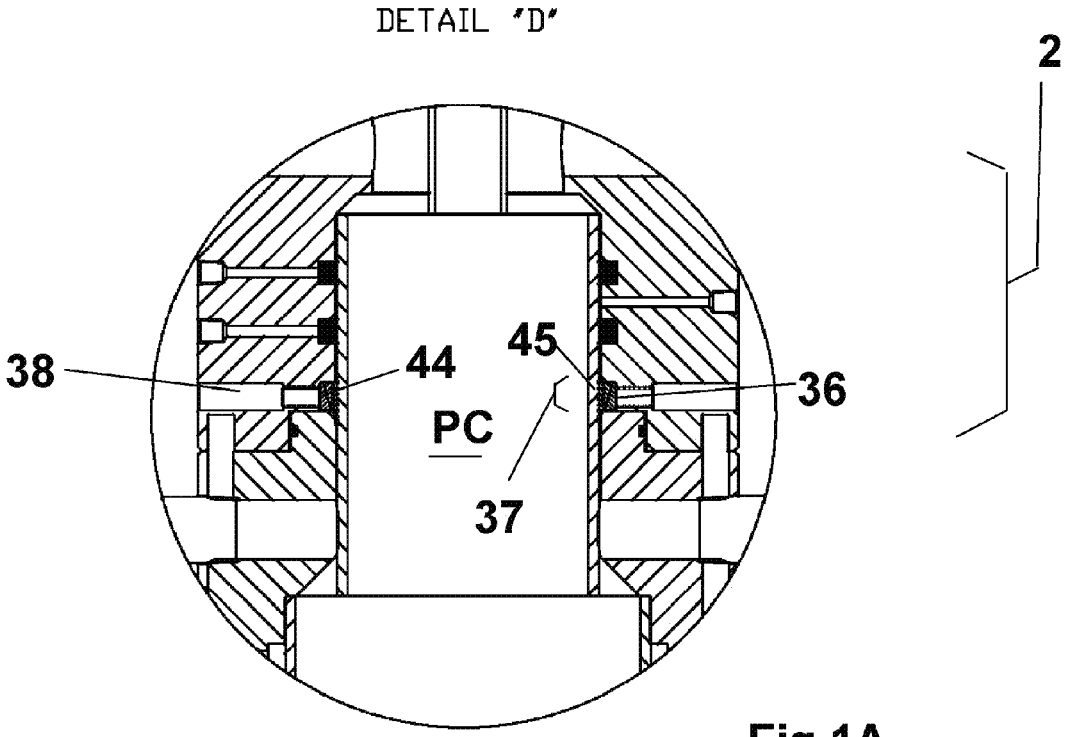
FIG. 1A is a close-up view of the upper wellhead portion of the wellhead of FIG. 1.

Continuing with FIGS. 1 and 1A, the upper wellhead portion 2 may include includes a bite ring slot 44 containing an inner bite ring 45 and wedge ring 36, the inner bite ring having a gripping surface 37 comprising teeth and actuation screws via threaded apertures 38 to engage wedge ring 36 to form an upper wellhead portion anchoring system having the same components and operation as the wellhead anchoring system of the lower casing head (illustrated in detail in FIGS. 3A and 3B) which one should reference for details as to the components and operation, with the present anchoring system a component of the upper wellhead portion 2, and is for engaging same securely to the production casing PC.

With the actuation screw tightened, the gripping surface (shown as teeth) engage the casing such that upward force (fluid pressure from the casing) forces the wedge ring to apply further lateral pressure (due to the thicker upper wedge portion) to the inner bite ring so that the gripper teeth further engage the casing.

Thus, the harder the wellhead is urged upward (such as via well pressure), the more gripping force is applied to the casing by the locking head elements, so as to prevent pressure push off. As earlier indicated, the wedge ring and inner bite rings have a gap (for example, 1 inch but may vary depending upon size and application) to allow compression of the rings to grip the casing on demand, and retract to a non-gripping position once pressure from the actuation screw is relieved. It is noted that the utilization of the above disclosed anchoring system (via bite ring 45 and wedge ring 36 may be discretionary where a lower casing head is used having its own anchoring system about a casing.

Situated above the anchor mechanism is packing injection port (PIP) 30, 30', as shown wherein packing is injected into the seal area to form a p-seal, utilizing known industry products and methodology. Packing ejection ports (PEP) associated with the seal areas 9, 9', for overflow, may also be utilized.

Referring to FIGS. 4A-4C, the prior to installation of the wellhead (including the lower casing head, the production casing is "wedding caked", that is, the surface casing and production casing are cut such that the production casing emanates from the surface casing at a predetermined range suitable for mounting the dual annulus wellhead arrangement. The production casing is then centered in the surface casing via the use of a centralizer 35, which comprises a cylindrical spacer which is tapered to a point 31 at the base and spaced to the desired spacing 32 at the top. The centralizer has an inner diameter formed to engage the outer diameter of the production casing, and an outer diameter to engage the inner diameter of the surface casing, and a lip 33, to ride atop the surface casing to retain the centralizer in place, centering the production casing vis a vis the surface casing. Vent apertures are formed through the centralizer to allow passage of fluid pressure 34 therethrough.

It is noted that another centralizer having similar configuration is preferably also used center the tubing T emanating from the production casing utilizing a centralizer and technique as disclosed in the discussion of FIGS. 4A-4C, except that the centralizer dimensions will be smaller to fit between the production casing and the well tubing, with the centralizer situated therebetween, with the lip resting on the production casing.

An annular vent 40 is provided above the PIP in the lower casing head to vent from the surface casing area, as is common on many wellheads.

It is noted that, though the present system is shown utilizing a lower casing head (5 referenced in FIGS. 1 and 1A), in situations where there is no surface casing or as otherwise desired, the upper wellhead portion may be utilized without the lower casing head to form the wellhead.

In such a case, the lower casing head is removed, and a anchoring system (via inner bite ring 9, wedge ring 13 as discussed above must be provided in the upper wellhead portion, held in place via retainer ring 26 and actuated via actuation screws 18 as discussed above and in the discussion of FIG. 1.

Tubing Jack and Operation Thereof

While the following discussion references the dual annulus, stacked wellhead comprising the lower casing head 5 and the upper wellhead portion 2, please note that the use of this two component, dual annulus wellhead is for purposes of illustration only, and that the following apparatus can be utilized with any suitable wellhead.

Referring to FIGS. 1, 2, 2A, and 5, medially situated at the second end 3' of the wellhead is mounted a lower tubing bowl 46 for receiving tubing slips 47 which are formed to engage tubing T to selectively retain or release said tubing utilizing standard configuration slips and slip operation, which control is accomplished by operator directed lower slip control cables 48. The tubing bowl has formed along its length screw passages 50, 50' (eight would be used in this example) formed to receive lock down screws to affix the tubing bowl 46 to raised mounting flange 51 emanating from the top of the wellhead.

For use of the present wellhead with a tubing jack 59, a tubing jack flange 54 is mounted about the base of the slip bowl, to the upper, second end 3' of the wellhead via cylinder pins 56 situated in cylinder pin passages 55, 55', which are spaced circumferentially about the diameter of the tubing jack flange, the cylinder pins each threadingly engaging a respective threaded passage formed in the sidewall of raised mounting flange 51 on wellhead. As shown, each cylinder pin 56 has first and second ends, and a length, the first end having a head for engaging or disengaging the cylinder pin. The second end having a relatively short (less than 10% of the length) threaded portion formed to engage the threaded passage formed in the sidewall of the raised mounting flange 51, and a smooth outer cylinder for the remainder of the length. This allows for an easy installation under difficult conditions, such as by a diver underwater.

The tubing jack flange 54 forms a lower jack plate to support hydraulic cylinders 60, 60', 60". As shown, emanating from each hydraulic cylinder is a piston rod supporting an upper jack plate 61 having a central opening 69 for receiving the tubing therethrough, the central opening having an upper bowl 70 with upper slips 71 associated therewith for engaging the outer diameter of the tubing to grip same selectively in conjunction with the lower slip bowl, which upper slips 71 are controlled via upper slip control cables 72 manually by an operator, which can include a diver or the like. Both the lower and upper slip control cables control the position of the slips (which are comprised of slip segments) so as to position the slips into a retracted position wherein the tube T is able to pass through the slips, and an extended position, wherein the surface of the slips engage the tubing and forces the slips along the slip bowl so as to wedge the slip segments between the slip bowl and the tubing, to hold the tubing. As indicated, the upper slip control cable controls the upper slips independent of the lower slip control cable, which controls the lower slips.

For example, in a well with a 7⅝" production casing, 10¾" surface casing, and 2⅞ tubing, three five ton jacks can comprise the tubing jack.

The present wellhead with tubing jack arrangement is designed with P & A low pressure completion in mind. It is also designed to be diver friendly with quick connector pieces via cylinder pins and locking rings. It has the ability to be installed quickly and the ability to isolate 1 or 2 zones.

In use, prior to installing the wellhead at a damaged well site, all of the debris would be cleared and any bent tubing or pipe would be cut and removed.

1) Installation of the custom ported (vented) centralizers should be installed prior to installing the head for 2 annuli. This will ensure concentric pipe when slipping the head down on the casing. Centralizers will slip down tubing, casing, etc. and into the annuli. They will shoulder out on top of casing, as disclosed supra. 2) A Tensioner Jack can be used to push down the centralizers if needed.

3) Once centralized, the wellhead head is to be slipped over the tubing and set down on the top of the casing. The locking ring is energized to secure the head in place. The upper & lower slips can be put in after this is done or left in place as it is being slipped down.

4) At this time the p-seals can be packed off in the casing head assembly, utilizing a packing gun, for example.

5) Once this is accomplished and a test on the seals have been achieved, energizing the lower lock ring screws (or actuator screws 18) to lock the head on, must be done at this time.

6) At the upper end of the lower slip bowl are 8 lock down screws. These screws should now be energized to compress hanger compression seal.

7) Once this is done, a casing pressure test at 1500 psi should be applied, to test the integrity of the casing.

8) Once this is done successfully, if tension is desired in the tubing, the hanger seal screws are to be loosened to allow for the tubing to be pulled upward, with step 9, without damaging the seal in the hanger.

9) Once it is tested and the hanger seal is loosened, the cylinders should be energized to start pulling the tubing upward with the upper slips and it will push down the head onto the casing until it shoulders out inside of the head.

10) Tension now begins to be pulled on the tubing.

11) The upper & lower slips work together with the stroke of the cylinders. In the present embodiment, the cylinders have 18" of stroke in a ratcheting effect to set tension in the tubing and also lock the head down against the shoulder of the head.

12) In the event of a tubing collar coming in contact with the hanger during the process, the hanger is able to ride up and out of the bowl. They are split to allow them to open out and around the collar to allow it to pass through the bowl.

13) Then it can be reinstalled below the collar to grip the pipe.

The seals on the casing head section would need to be packed off with pumpable packing in order to seal on the casing.

14) The tension pulling downward will compress the tubing seal. This will seal off the void between the casing and the tubing. Now, the hanger lock screws should be energized. This is a specially designed seal which will not over compress regardless of the downward force.

15) Once this is completed, the upper slips are to be removed and the jack lowered.

Once these steps have been done and all seal tests have been performed, P & A operation can begin.

16) A dry cap and tubing can be installed at this point, if desired, by unlocking (via lock pins) and removing the jack assembly, and installing and locking the dryhole bowl cap. After securing, a test can be performed to check the tubing to cap seal.

17) Next, the tubing can be cut to the desired length (for example, 1'-5') to allow ease of attachment after the P&A process is performed.

A tubing cap is then to be installed (by slipping it down over the end of the tubing) by using the modular cap with lock rings, or locking same in place via threaded fasteners (i.e., rods and nuts).

Once these steps are completed and tested, the well can either be left alone until ready to decommission or it can be attached to wireline omg services to decommission at present.

Subsea Wellhead System

As discussed, the present system is configured to accommodate and properly position or centralize dual or single annuli, along with heading the tubing with the present modular components. Its unique design incorporates the ability to capture dual or single annuli, head the tubing, the modular components herein, attachable tensioning jack, all in one compact package.

The design gives the user the ability to pull tension into the tubing with the use of the hydraulic jack system, which attaches to the casing head component.

Once the well has been prepped for well heading, this system is particularly suitable for operation by a diver or even an ROV (remotely operated vehicle).

In such as scenario, the lower casing components are lowered onto the casing.

In such an operation, if a dual annulus head is to be installed, a centralizing bushing (centralizer) should first be installed between the casing, as with the conventional operation earlier discussed.

Figure 6:
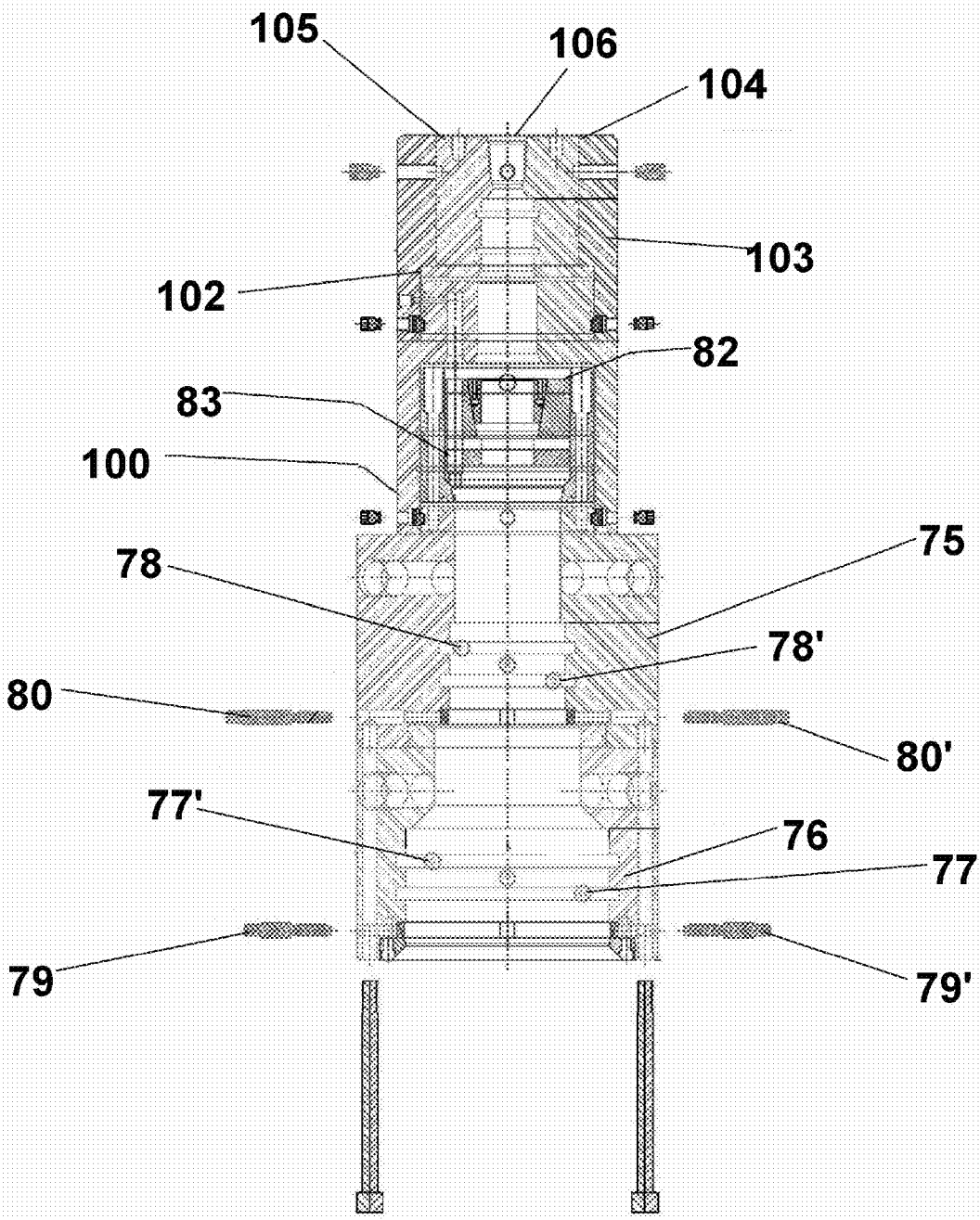
FIG. 6 illustrates the stackable wellhead components particularly adaptable for subsea installation by divers and ROV, but useable in dry applications as well.

Referring to FIG. 6, once the head (in this case, because it is dual annulus the head comprises the upper wellhead portion 75 and lower casing head 76, or alternatively can comprise a single dual annulus wellhead, or a wellhead having receiver for casing bushings of various sizes to fit various casings) is slipped down onto the casing, either by diver or ROV, the packing is to be injected into the PIP ports 77, 77', 78, 78' on casing head/heads. At this point, either by diver or ROV, a test must be performed to check the seal capacity.

Once a seal is achieved, either by diver or ROV, the lock ring energizing (actuation) screws 79, 79', 80, 80' are to be tightened using a sequence alternating starting at 1 to allow the lock ring to bite and wrap at the same time to provide optimal strength.

Once this is done, the installation of the tubing hanger 82 with the control line tube 83 is to be attached. The control line tube is used to terminate the control line of the sub surface safety valve. The hanger has slips which hold the tubing up once tension is pulled. To pull tension, the tension jack is to be installed either by diver or ROV.

Once it is slipped over the hanger bowl and set down on the casing head. The lock pins hold it in place until the tension operation is completed. After tensioning, the tubing jack is unlocked and lifted up and over to remove same. At this time the dual or single annuli strings of pipe are sealed, with the tubing remaining to be sealed off.

With the present invention there are two types of tubing cap systems:

The first consists of a bowl cap 64 (FIGS. 2A, 2B, 2C, and 2D) which slips over the end of the tubing T, and attaches to the raised flange 51 on the top of the wellhead. The raised flange 51 has a slot 52 formed along its outer diameter to accommodate six locking ring segments 67, 67', each lock ring having a slot formed to engage lock pins 66 via locking pin passages but leaves the tubing T sticking out of the top. This cap is more of a hanger cover cap. Each lock pin 66 has a threaded 68 length 62 having first 63 and second 63' ends, the first end having a head 57 for engagement by a tool for installation and the second end a flange 58 which is spaced from the body by a shank 85. Each ring segment has a slot 86 formed to receive flange 58, and a slot 87 in the outer surface 88 to receive shank 85. The inner surface 89 of each ring segment has a slight angle so that, upon tightening 91 the locking pin 66, the ring segment engages the slot in flange to urge the actuation screw and component to which it is attached (in this case, the bowl cap) against 90 the item to which it is being affixed (in this case the wellhead) for a secure fit.

The bowl cap 64 also has formed along its inner diameter 92 a slot 93 to receive each ring segment, to which the locking pin passages 65 communicate. Prior to installation, the locking pin is threaded through the locking pin passage 65 so that the locking pin flange and shank can engage the respective locking ring segment, and the locking pin is then threaded back 94 to place the locking ring segment wholly within the slot 93 in the bowl cap 64.

For installation, with the locking ring segments situated within the slot formed in the apparatus to be connected (in this case the bowl cap), the apparatus is positioned such that the locking ring segments are aligned with the slot formed the wellhead flange, and the locking pins are turned to urge via the threads the locking pins out of the bowl cap slot 93, urging the locking ring segments into the slot formed in the wellhead flange, ultimately contacting the inner wall of the slot and, via the angled profile of the locking ring segments, urging the bowl cap in a "locked down" configuration.

Alternatively, the tubing cap may be affixed by drilled & tapped holes (for example, six) in the top of it to use as attachment points for the top hat tubing cap. This application is more for short term deployment of the system.

Figure 2:
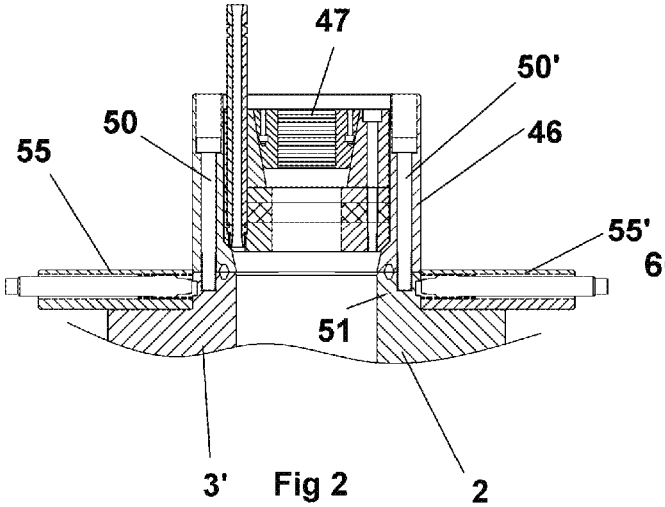
FIG. 2 side, cross-sectional view of the lower slip bowl and slips of the present invention, mounted to an upper wellhead, with a casing jack flange of the present invention situated thereabout.
Figure 2A:
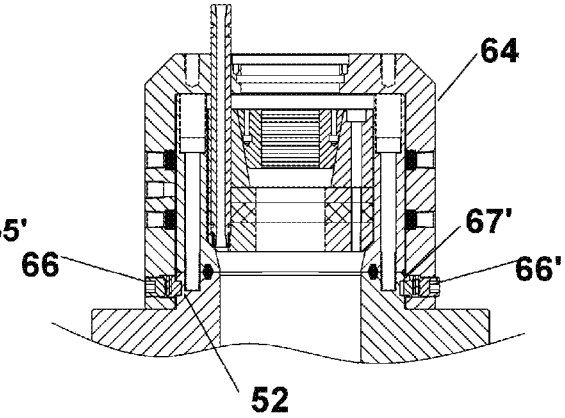
FIG. 2A is a side, cross-sectional view of the bowl cap of the present invention illustrating the unique locking ring/pin system.
Figure 2B:
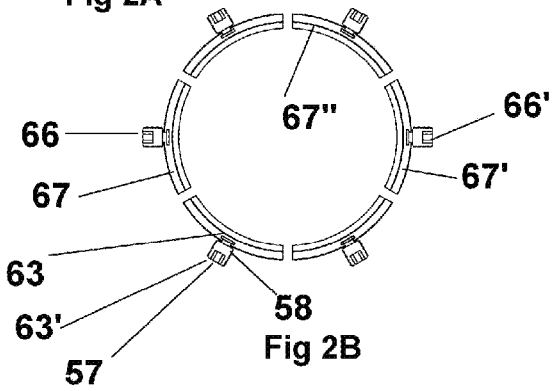
FIG. 2B is a top view illustrating the locking pin segments forming the locking ring system, along with the locking pins used therewith.
Figure 2D:
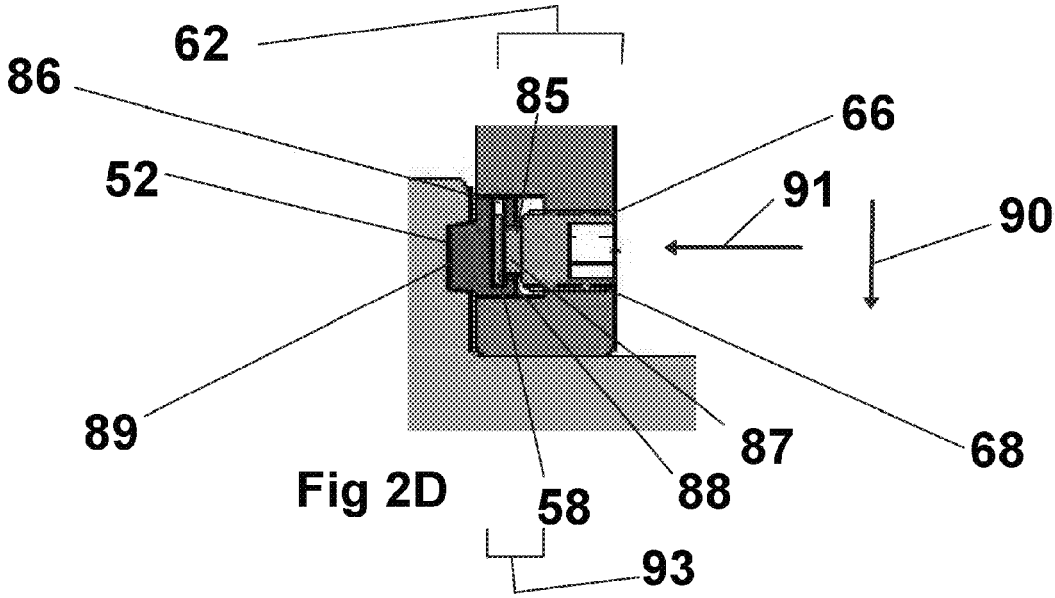
FIG. 2D is a close-up, cross-sectional view of the locking ring engaged to the wellhead flange, with the locking pin flange engaged to the locking ring, retaining the component (in this case, a bowl cap) in place.
Figure 2C:
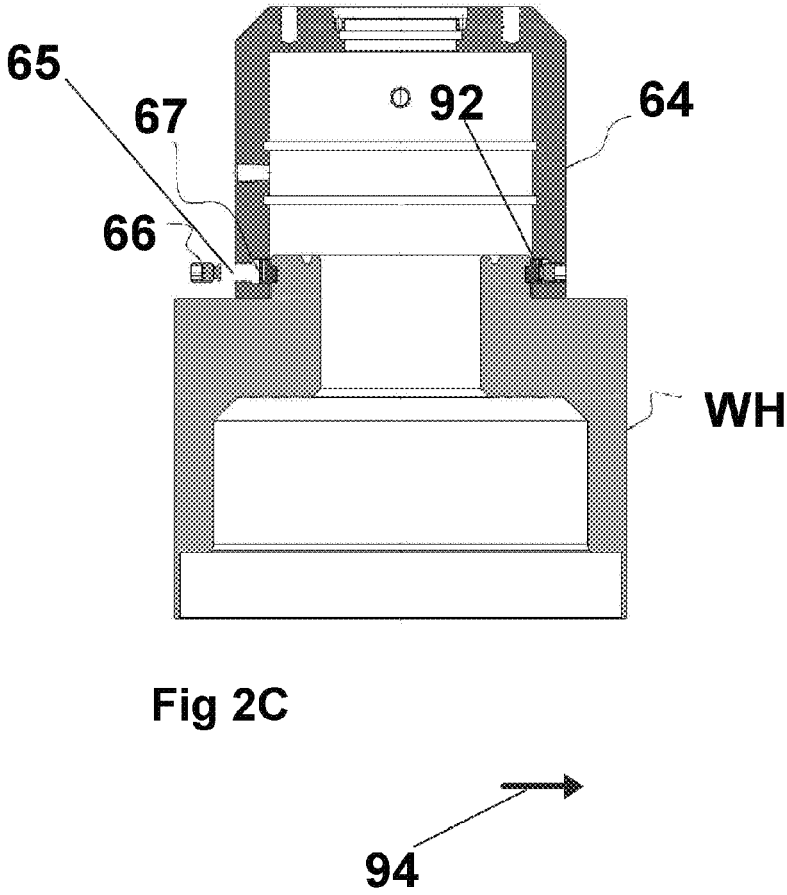
FIG. 2C is a side, cross-sectional view of a bowl cap mounted to a wellhead using the locking ring system of FIGS. 2A and 2B.

Referring to FIGS. 6 and 2A-2D, the alternative long term tubing cap installs in a similar fashion. First the tubing cap adapter 100 is slipped over the tubing and is set down and locked to the casing head with the locking pins (which also terminates the CCL port) utilizing the locking ring segments and locking pins as shown in FIGS. 2B-2D and as described in the description of the bowl cap, above. The tubing cap adapter includes a raised flange 102 which has an outer diameter with a slot formed therein to receive the tubing cap having a locking ring segment and pin system for locking down same, again as described above in FIGS. 2A-2D, the tubing cap having a slot formed in its inner diameter to receive the locking ring segments and having threaded locking pin passages same as described above, so that the tubing cap is slipped down over the tubing and locked down to the tubing cap adapter utilizing the locking ring segment system, above. In the embodiment illustrated in FIG. 6, the tubing cap has a receiver 104 formed therein to receive a tubing bushing 105 having a tubing termination passage and valve connector 106 sized for the particular tubing utilized with the job. Bushings having various tubing diameters or connections may thereby be provided to be used with the tubing cap, allowing a single tubing cap to be utilized with various sized bushings and for various connection requirements.

At this point the have successfully installed, sealed off and tested the tubing bore which is also now set in tension.

In use, the tubing cap adapter is installed as follows:

Stage 5: Install the Tubing Cap Adapter

1. Carefully lower the tubing cap adapter to just above the 2⅞" tubing.
2. Slowly lower the tubing cap adapter, stripping it over the tubing and the control line nipple, landing on the top face of the wellhead.
3. Run in the 6 lock-down pins in an alternating cross pattern till tight.
4. Retrieve the hydraulic source line and connect to the test port.
5. The surface operator will pump hydraulic fluid at a slow rate to approximately 500 psi. Monitor pressure and observe for a pressure decrease.
6. Once the pressure has stabilized, continue pumping pressure until a stable pressure equal to 50% of the casing collapse pressure or 5,000 psi, whichever is less.
7. Once a satisfactory test is achieved, the surface operator will bleed off all test pressure.
8. Disconnect the hydraulic source line and secure out of the work location.

Figures 7, 8:
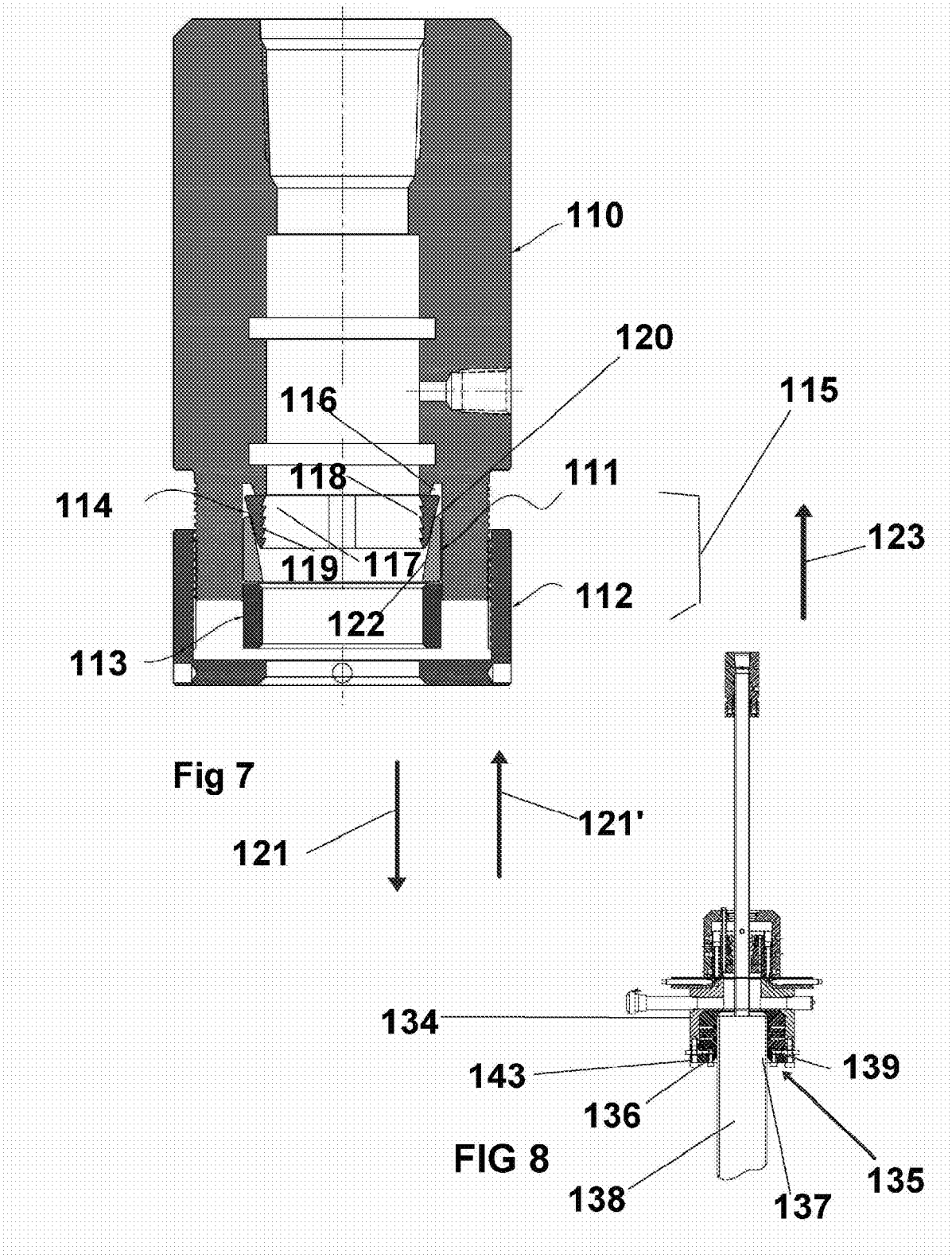
FIG. 7 is a cross-sectional view of the tubing connector of the present invention utilizing the reverse wedge locking system.
FIG. 8 illustrates the wellhead of the present invention having a receiver for receiving a casing bushing to allow for various size casings to be used with a single wellhead (having various diameter interchangeable receivers).

Continuing with FIG. 7, the tubing body connector 110 of the present invention incorporates a reverse wedge design anchoring apparatus similar to that taught to anchor the wellhead to the casing, but with some differences.

A variation of the reverse wedge locking system 115 for selectively anchoring the tubing body connector 110 to the end of the tubing T comprises a bite ring slot 116 formed to receive an inner bite ring 114. The inner bite ring 115 is in a circular, ring configuration, but with a gap (for example, the size varying depending upon its size) along its diameter to allow for a compression or decrease in the diameter when force is applied to the outer diameter, as will be further detailed infra.

The inner bite ring 114 has an inner diameter having a gripping surface 117, the preferred embodiment utilizing a gripping surface 117 comprising rows of serrated teeth 118, each row of teeth having a point 119 oriented towards the upper end of the tubing to which it engages. The outer diameter of the inner bite ring 114 has a taper 120 in a first direction 121 to form a wedge profile.

Situated about said inner bite ring 114 is an outer wedge ring 111 having an inner diameter and an outer diameter, said inner diameter having a smooth surface formed to engage said outer diameter of said inner bite ring, said outer wedge ring 111 situated in said bite ring slot 116 between said inner bite ring and said tubing body connector, said inner diameter of said wedge ring being tapered 122 in a second direction 121' opposite to said first direction of said inner bite ring 114 to form a wedge profile, said inner diameter of said outer wedge ring 111 formed to engage said outer diameter of said inner bite ring 114.

An engagement cap 112 is provided such that, when tightened, urges a spacer ring 113 to engage and urge 123 said outer edge ring 111 about said inner bite ring 113, the reverse wedge configurations of said outer bite ring 111 and said inner bite ring 113 causing the inner bite ring 113 to compress in diameter, with its gripping surface 117 engaging and gripping the tubing.

Figures 3A, 3B:
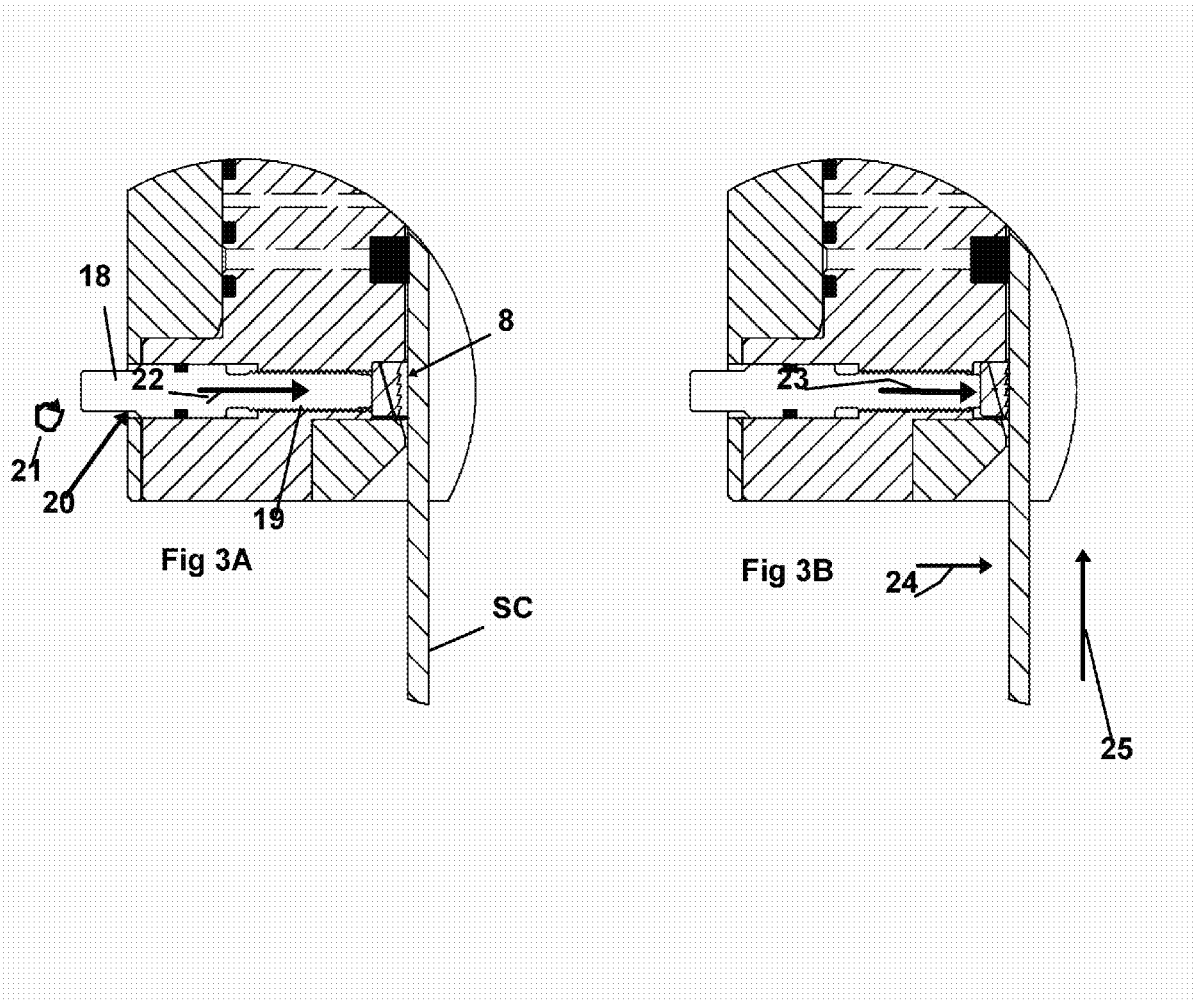
FIG. 3A illustrates a side, cutaway view of the reverse wedge locking system of the wellhead of FIG. 1, in the disengaged position.
FIG. 3B is a view of the reverse wedge locking system of FIG. 3A in the engaged position.
Figure 3C:
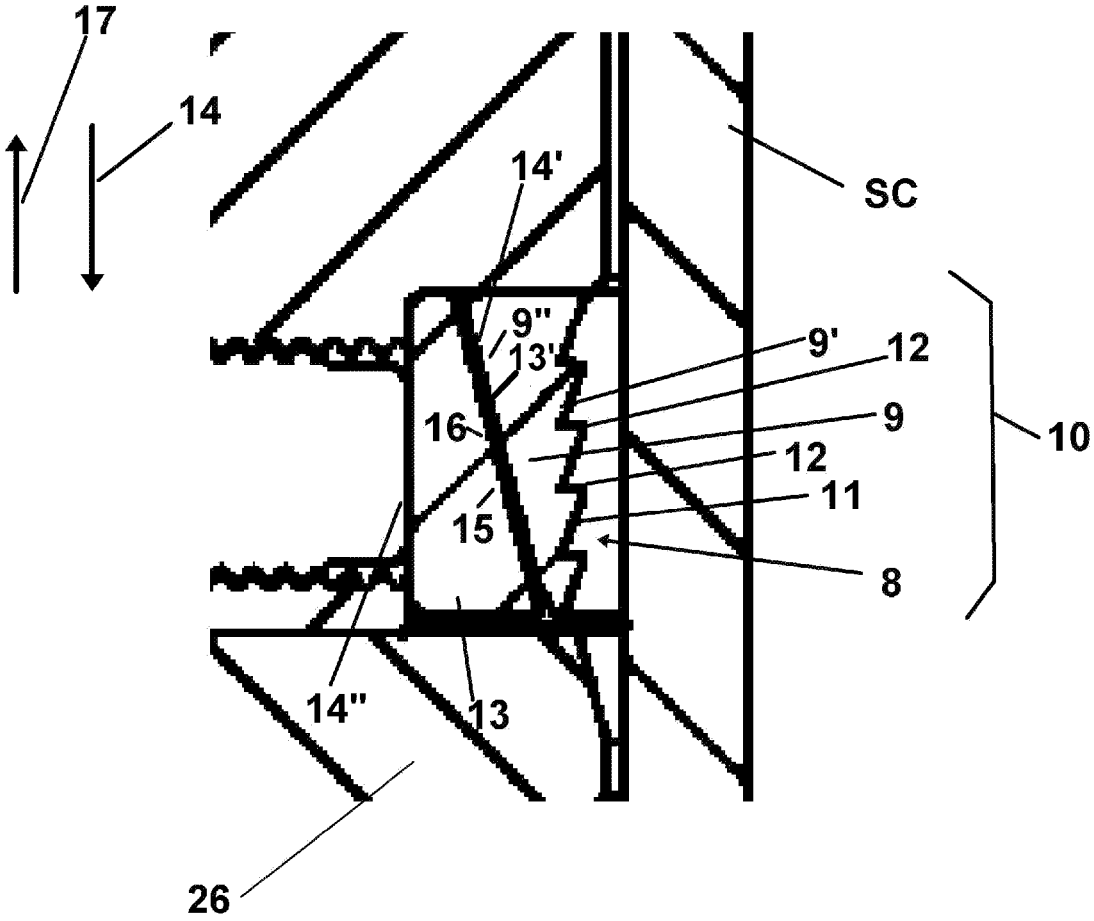
FIG. 3C is a close-up view of the invention of FIG. 3A.

FIG. 7A illustrates a wellhead 134 having a receiver 135 formed therein to receive various configuration interchangeable bushings 136 which may have a passage of different internal diameters 137 to engage different sized casing 138, the interchangeable bushing 136 including a reverse wedge locking system 139 of the type disclosed herein in FIGS. 1, 3A and 3C et al, seal ports 140, and connected via threaded connectors 143, which makes this system versatile from project to project.

Figure 9:
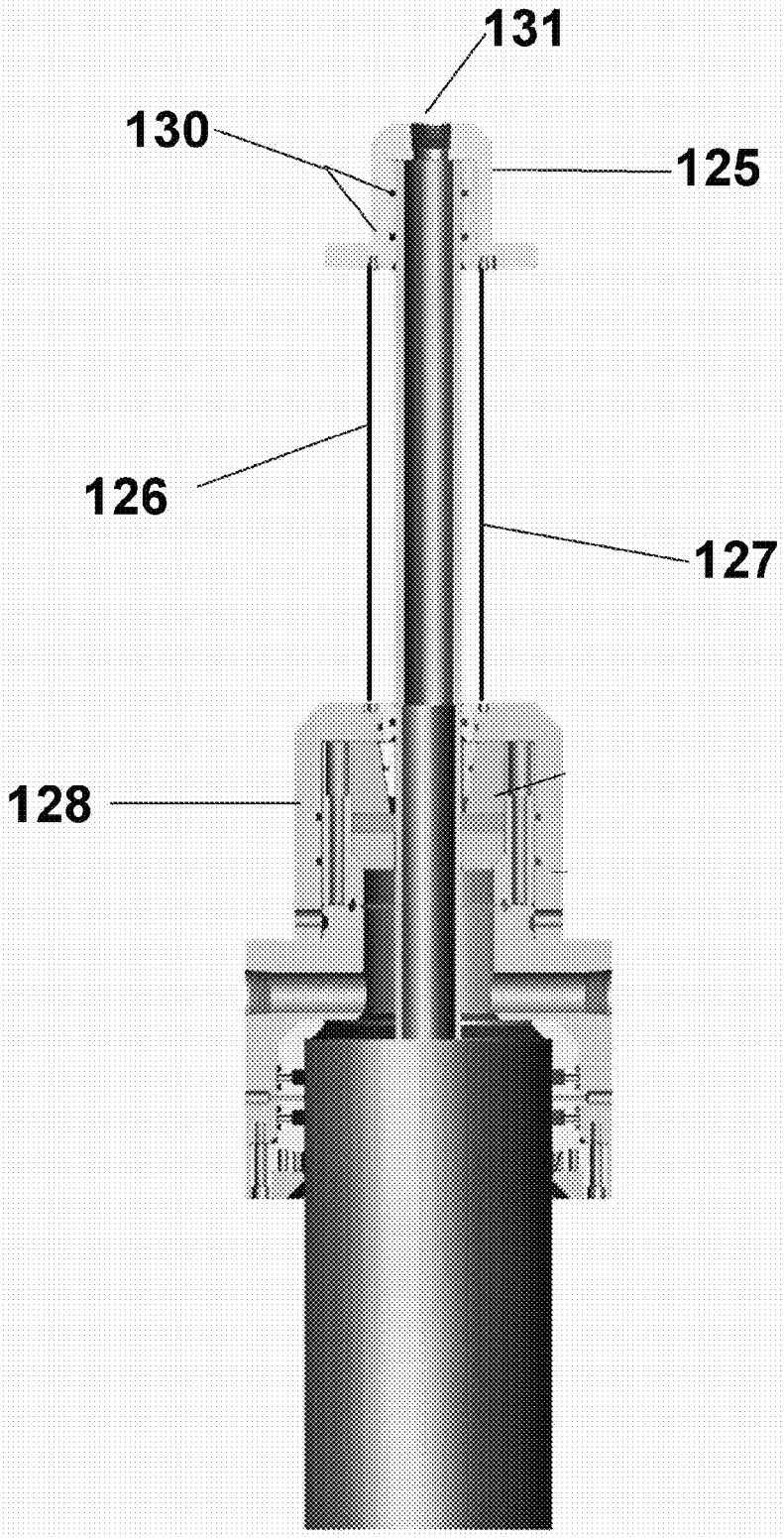
FIG. 9 is a view of a "top hat" tubing connector utilizing threaded rods to the bowl cap.

FIG. 9 illustrates a tubing connector 125 which, instead of the reverse locking system of FIG. 7, utilizes first 126 and second 127 threaded rods which engage the bowl cover 128 to retain the cap in place. As shown, the tubing connector includes seals 130 which communicate with the outer diameter of the tubing to seal off same, as well as a threaded passage end 131 to receive a valve, pipe or the like.

Some advantages of the present system over the prior art include:

1) The unique locking system with the reverse wedge design is incorporated into the bottom casing connector.

2) The rental head system has interchangeable bushing thru out the stack up of parts from the lower casing connector to the tubing cap on top. All of the internal sealing components can be changed to fit a different size tubing/casing to allow this system to be converted in the field.

3) The STAB-N-LOC system has a removable bottom connector. This allows the user to set the head up to capture dual casing annuli or single casing annuli with out having to manufacture a new head.

4) The unique connecting features of this system is very different from existing wellhead system in that other systems connect together using studs/bolts and nuts. The STAB-N-LOC system utilizes a unique loc pin into a loc ring design incorporated into each component to allow for strength and ease of assembly under the surface or any where this system would benefit.

5) During the deployment of this system, ROV could also be utilized to install this system with minor modifications that would make it ROV friendly. These applications would save time and money on deep water well interventions, where other wellhead systems would not be able to be deployed this way.

6) Divers have been installing conventional/retrofitted wellheads on the damaged wells since the storms and it has turned divers into wellhead technicians. This system was designed to make this task easier for the divers to install along with speeding up the process and making a system that suits the application and lets the divers worry about diving and not so much about the system there installing.

7) The STAB-N-LOC system is the most diver friendly wellhead system on the market along with having the unique ability to convert, pull tension, complete single or dual/tubing or annuli. Being removed after completion and utilized for the next well without needing to come in for repairs regardless of the next casing string is unique on its own.

RECITATION OF THE ELEMENTS

W wellsite
SC surface casing
PC production casing
T tubing
1 modular stackable wellhead
2 upper wellhead portion

3,3' first second ends
4, ' passageway, ID
5, 'lower casing head, OD
6, ' first, second ends
7, 'passageway, ID
8 bite ring slot
9, ', " inner bite ring, inner, outer diameter
10 gripping surface
11 teeth
12 point
13 wedge ring
14, ', " first direction, inner diameter, outer diameter
15 smooth surface
16 tapered
17 second direction
18 actuation screw
19 threaded
20 screw apertures
21 turning
22 urges
23 wedge ring against
24 decrease diameter
25 urges
26 lower retaining ring
27 reverse wedge locking system
28
29
30, ' PIP
31 point
32 spacing
33 lip
34 pressure
35 centralizer
36 wedge ring
37 gripping surface
38 threaded apertures
39
40 annular vent
41
42 bolts
43 threaded aperture
44 bite ring slot
45 inner bite ring
46 lower tubing bowl
47 tubing slips
48 lower slip control cables
49 raised flange
50, ' mounting screw passages
51 raised flange in wellhead
52 slot in raised flange
53
54 tubing jack flange
55 cylinder pin passages
56 cylinder pins
57 pin head
58 pin flange
59 tubing jack
60, ', " hydraulic cylinders
61 upper jack plate
62 length
63, ' pin first, second ends
64 bowl cap
65 locking pin passage
66, ' lock pins screws
67, ', " lock ring segments
68 threaded
69 upper central opening
70 upper slip bowl
71 upper slips
72 upper clip control cables
73
74
75 upper wellhead portion
76 lower casing head
77, ' pip ports subsea wellhead
78 tubing hanger
79, ' locking ring actuation screws
80" (upper wellhead)
81
82 tubing hanger
83 control line port
84
85 pin shank
86 ring segment slot
87 ring segment outer surface slot
88 ring segment outer surface
89 ring segment inner surface
90 against
91 tightening
92 id
93 slot
94
95
96
97
98
99
100 tubing cap adapter
101
102 raised flange
103 tubing cap
104 receiver
105 tubing bushing
106 tubing termination passage and valve connector
107
108
109
110 tubing body connector
111 outer wedge ring
112 engagement cap
113 spacer ring
114 inner bite ring
115 reverse wedge locking system
116 bite ring slot
117 gripping surface
118 serrated teeth
119 point
120 taper
121, 'first, second direction
122 wedge ring taper
123 urge
124
125 tubing connector
126 first rod
127 second rod
128 bowl cover
129
130 seals
131 threaded passage end
132
133
134 wellhead
135 receiver
136 interchangeable bushing

137 ID
138 casing
139 reverse wedge locking system
140 pips seal ports
141
143 threaded connectors The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

I claim:

1. A method of servicing a well, comprising the steps of:

a. providing a wellhead having first and second ends, and mounting said first end of said wellhead to a casing having an outer diameter;

b. utilizing an inner bite ring associated with said wellhead to engage said outer diameter of said casing, anchoring said wellhead to said casing;

c. forming a fluid seal between said outer diameter of said casing and said wellhead;

d. mounting a lower slip bowl to said second end of said wellhead;

e. mounting a tubing jack having lower and upper ends to said second end of said wellhead such that said lower end of said tubing jack engages said wellhead and is situated about said lower slipbowl;

f. mounting an upper slip bowl to said upper end of said tubing jack, said upper slipbowl aligned with said lower slipbowl;

g. utilizing slips with said lower slip bowl and said upper slip bowl to engage a conduit coaxially emanating from said casing;

h. utilizing said tubing jack to lift and remove said conduit from said casing as well as straighten any bends in said conduit, leaving an end of said conduit emanating from said wellhead;

i. removing said tubing jack and upper slip bowl, j. providing a tubing cap having an inner diameter, and a tubing cap bushing having an inner diameter and an outer diameter, said outer diameter formed to engage said inner diameter of said tubing cap, said inner diameter of said tubing cap bushing formed to engage said tube end emanating from said casing; and k. placing said tubing cap bushing over said end of said conduit, and said tubing cap over said tubing cap bushing, so as to cap said end of said conduit.

2. The method of claim 1, wherein said conduit comprises tubing or pipe.

3. A method of servicing a well, comprising the steps of:

a. providing a wellhead having first and second ends, and mounting said first end of said wellhead to a casing having an outer diameter;

b. utilizing an inner bite ring associated with said wellhead to engage said outer diameter of said casing, anchoring said wellhead to said casing;

c. forming a fluid seal between said outer diameter of said casing and said wellhead;

d. mounting a lower slip bowl to said second end of said wellhead;

e. mounting a tubing jack having lower and upper ends to said second end of said wellhead such that said lower end of said tubing jack engages said wellhead and is situated about said lower slipbowl;

f. mounting an upper slip bowl to said upper end of said tubing jack, said upper slipbowl aligned with said lower slipbowl;

g. utilizing shams said lower slip bowl and said upper slip bowl to engage a tubing coaxially emanating from said casing;

h. utilizing said tubing jack to lift and remove said tubing from said casing as well as straighten any bends in said tubing, leaving an end of said tubing emanating from said wellhead;

i. removing said tubing jack and upper slip bowl;

j. providing a tubing connector having an inner diameter to engage said tube end emanating from said casing; and k. placing said tubing connector over said end of said tubing, and a tubing cap over said tubing connector, so as to cap said end of said tubing.

4. A method of servicing a well having, a first casing emanating from a second casing, comprising the steps of:

a. providing a universal wellhead comprising:

a universal wellhead component having first and second ends with a passage formed therethrough, said passage having first and second inner diameters forming first and second openings, at said first and second ends of said universal wellhead component, respectively, a casing bushing having a passage therethrough having an inner and outer diameter, said outer diameter formed to engage said inner diameter of said universal wellhead at said first end of said universal wellhead, said inner diameter formed to engage the outer diameter of said first casing, said casing bushing further having situated therein an inner bite ring formed to engage and grip the outer diameter of said first casing;

a lower casing head comprising first and second ends with a passage formed therethrough, said passage having first and second inner diameters forming first and second openings at said first and second ends of said lower casing head, respectively, said first inner diameter formed to engage said second casing situated about said first casing, said lower casing head further having situated therein an inner bite ring formed to engage and grip the outer diameter of said second casing, said second end of said lower casing head formed to engage to said first end of said universal wellhead component to form a combined wellhead having dual annulus;

b. measuring said first casing, and selecting said casing bushing so as to have an inner diameter sufficient to envelope the end of the first casing;

c. mounting said casing bushing to said universal wellhead component, providing said universal wellhead with casing bushing;

d. mounting said lower casing head to said second casing such that said first casing emanates through the top of said lower casing head;

e. utilizing said inner bite ring associated with said lower casing head to engage said outer diameter of said second casing, anchoring said lower casing head to said second casing;

f. forming a fluid seal between the outer diameter of said second casing and said lower casing head;

g. mounting said universal wellhead with casing bushing to said lower casing head; mounting said casing bushing about the outer diameter of said first casing so as to envelope said first casing;

h. utilizing said inner bite ring associated with said casing bushing to engage the outer diameter of said first casing, anchoring said inner bite ring and said universal wellhead to said first casing;

i. utilizing threaded fasteners to lock said lower casing head to said universal wellhead;

j. mounting a lower slip bowl to said second end of said universal wellhead;

k. mounting a tubing jack having lower and upper ends to said second end of said universal wellhead such that said lower end of said slipbowl engages said universal wellhead and is situated about said lower slipbowl;

l. mounting an upper slip bowl to said upper end of said tubing jack, said upper slipbowl aligned with said lower slipbowl;

m. utilizing slips with said lower slip bowl and said upper slip bowl to engage a conduit coaxially emanating from said first casing;

n. utilizing said tubing jack to lift and remove said conduit from said casing, leaving an end of said conduit emanating from said wellhead;

o. removing said tubing jack and upper slip bowl.

5. The method of claim 4, wherein in step "n" there is further provided the step of using said tubing jack to straighten said conduit.

6. The method of claim 4, wherein said conduit comprises tubing or drill pipe.

7. The method of claim 6, wherein after step "o" there is further provided the additional step "p" of providing a tubing cap having an inner diameter, and a tubing cap bushing having an inner diameter and an outer diameter, said outer diameter formed to engage said inner diameter of said tubing cap, said inner diameter of said tubing cap bushing formed to engage said tube end emanating from said casing, and step "q" of placing said tubing cap bushing over said end of said tubing, and said tubing cap over said tubing cap bushing, so as to cap said end of said tubing.

8. The method of claim 6, wherein after step "o" there is further provided the additional step "p" of providing a tubing connector having an inner diameter to engage said tube end emanating from said casing, and "q" of placing a tubing cap bushing over said end of said tubing, and a tubing cap over said tubing cap bushing, so as to cap said end of said tubing.

9. A modular wellhead system, comprising:

a universal wellhead component having first and second ends with a passage formed therethrough, said passage having first and second inner diameters forming first and second openings, at said first and second ends of said universal wellhead component, respectively, a casing bushing having a passage therethrough having an inner and outer diameter, said outer diameter formed to engage said inner diameter at said first end of said universal wellhead, said inner diameter formed to engage an outer diameter of a first casing, said casing bushing further having situated therein an inner bite ring formed to engage and grip said outer diameter of said first casing;

a tubing jack having a first end formed to engage the second end of said universal wellhead component, a lower slip bowl formed to engage second end of said universal wellhead at said second opening of said passage, said lower slip bowl formed to receive and engage a conduit emanating from the first casing;

an upper slip bowl mounted to said second end of said tubing jack, said upper slip bowl aligned with said lower slip bowl to receive and selectively engage said conduit; and a lower casing head comprising first and second ends with a passage formed therethrough, said passage having first and second inner diameters forming first and second openings at said first and second ends of said lower casing head, respectively, said first inner diameter formed to engage a second casing situated about said first casing, said second casing having an outer diameter, said lower casing head further having situated therein an inner bite ring formed to engage and grip the outer diameter of said second casing, said lower second end of said lower casing head formed to engage to said first end of said universal wellhead component to form a combined wellhead having dual annulus.

10. The apparatus of claim 9, wherein said casing bushing has a slot formed in said inner diameter of said passage, and wherein said inner bite ring is situated in said slot formed in said inner diameter of said passage formed in said casing bushing, said inner bite ring having an inner diameter having a gripping surface formed to engage said outer diameter of said first casing, and an outer diameter being tapered in a first direction to form a wedge profile, said inner bite ring being compressible in diameter;

wherein the application of force against said outer diameter of said inner bite ring decreases said inner diameter of said inner bite ring, so as to urge said gripping surface against said first casing so as to grip same; and wherein pressure from the end of said component from said first casing is counteracted by increased pressure of said gripping surface against said first casing facilitated by said wedge profile of said inner bite ring.

11. The apparatus of claim 9, wherein said inner bite ring of said lower casing head is situated in a slot formed in said inner diameter of said passage of said lower casing head, and wherein said inner bite ring is situated in said slot formed in said inner diameter of said passage formed in said lower casing head, said inner bite ring having an inner diameter having a gripping surface formed to engage said outer diameter of said second casing, and an outer diameter being tapered in a first direction to form a wedge profile, said inner bite ring being compressible in diameter; and wherein the application of force against said outer diameter of said inner bite ring decreases said inner diameter of said inner bite ring, so as to urge said gripping surface against a second casing so as to grip same; and wherein pressure from the end of said component from said second casing is counteracted by increased pressure of said gripping surface against said second casing facilitated by said wedge profile of said inner bite ring.

* * * * *